US010293347B2

(12) United States Patent
Bauer

(10) Patent No.: US 10,293,347 B2
(45) Date of Patent: May 21, 2019

(54) SOLID-BOWL SCREW CENTRIFUGE WITH AN OUTLET DEVICE HAVING A RESTRICTOR CONTROLLED BY A FLOATING BODY THAT FLOATS ON A LIQUID LEVEL OF THE MATERIAL BEING SEPARATED IN THE CENTRIFUGE TO AUTOMATICALLY ADJUST THE OUTLET IN DEPENDENCE ON A THROUGHPUT OF THE MATERIAL

(71) Applicant: Flottweg SE, Vilsbiburg (DE)

(72) Inventor: Georg Bauer, Geisenhausen (DE)

(73) Assignee: FLOTTWEG SE (DE)

( * ) Notice: Subject to any disclaimer, the term of this patent is extended or adjusted under 35 U.S.C. 154(b) by 886 days.

(21) Appl. No.: 14/601,426

(22) Filed: Jan. 21, 2015

(65) Prior Publication Data

US 2015/0217303 A1 Aug. 6, 2015

(30) Foreign Application Priority Data

Jan. 31, 2014 (DE) ..... 10 2014 101 205

(51) Int. Cl.
*B04B 1/20* (2006.01)
*B04B 11/02* (2006.01)

(52) U.S. Cl.
CPC ..... *B04B 1/20* (2013.01); *B04B 1/2016* (2013.01); *B04B 11/02* (2013.01); *B04B 2001/2075* (2013.01); *B04B 2001/2083* (2013.01)

(58) Field of Classification Search
CPC ..... B04B 1/20; B04B 11/00; B04B 11/02; B04B 2001/2083; B04B 2001/2075; B04B 7/08
USPC ..... 494/53, 54, 56, 57; 210/380.1, 380.3
See application file for complete search history.

(56) References Cited

U.S. PATENT DOCUMENTS 1,844,917 A * 2/1932 Fawcett ..... B04B 1/12 494/2
3,623,658 A * 11/1971 Garbaty
3,858,794 A * 1/1975 Nilson ..... B04B 1/20 494/4

(Continued)

FOREIGN PATENT DOCUMENTS

DE 1 757 532 4/1971
DE 196 18 249 11/1997

(Continued)

*Primary Examiner* — Charles Cooley
(74) *Attorney, Agent, or Firm* — Gerald E. Hespos; Michael J. Porco; Matthew T. Hespos

(57) ABSTRACT

A solid-bowl screw centrifuge is provided for the separation of multiphase material. The solid-bowl screw centrifuge has a centrifuge drum that is rotatable around an axis and the centrifuge drum has at least one outlet for discharging a phase of the material from the centrifuge drum. The outlet has a restrictor controlled by a floating body that floats on the material to adjust the outlet automatically in accordance with a liquid level of the material in the centrifuge drum, and the liquid level, in turn, is dependent on the throughput of the material. The restrictor may include a weighted body that is subjected to centrifugal force and also may include a restricting body arranged in a discharge port of the outlet. The outlet may include a deflection device for changing direction of the material flowing out to a direction that is transverse to the longitudinal axis.

8 Claims, 6 Drawing Sheets

(56) References Cited

U.S. PATENT DOCUMENTS

| | | | | | |
|---|---|---|---|---|---|
| 4,402,680 | A * | 9/1983 | Schoendorfer | | |
| 5,217,428 | A * | 6/1993 | Schlip | B04B 1/20 | 494/53 |
| 5,257,968 | A * | 11/1993 | Caldwell | B04B 1/20 | 494/53 |
| 5,618,409 | A * | 4/1997 | Kreill | B04B 1/14 | 210/149 |
| 5,913,767 | A * | 6/1999 | Feldkamp | B04B 1/20 | 210/117 |
| 7,311,654 | B2 * | 12/2007 | Ostkamp | B04B 1/20 | 494/53 |
| 8,231,515 | B2 * | 7/2012 | Hu | | |
| 9,993,831 | B2 * | 6/2018 | Pasol | B04B 1/20 | |
| 10,105,715 | B2 * | 10/2018 | Schlarb | B04B 1/20 | |
| 10,105,716 | B2 * | 10/2018 | Vielhuber | B04B 1/20 | |
| 2004/0058796 | A1 * | 3/2004 | Feldkamp | B04B 1/20 | 494/56 |
| 2015/0217303 | A1 * | 8/2015 | Bauer | B04B 1/2016 | 494/4 |

FOREIGN PATENT DOCUMENTS

| | | | | |
|---|---|---|---|---|
| DE | 19962645 A1 * | 7/2001 | | B04B 1/20 |
| DE | 102 03 652 | 8/2003 | | |

* cited by examiner

SOLID-BOWL SCREW CENTRIFUGE WITH AN OUTLET DEVICE HAVING A RESTRICTOR CONTROLLED BY A FLOATING BODY THAT FLOATS ON A LIQUID LEVEL OF THE MATERIAL BEING SEPARATED IN THE CENTRIFUGE TO AUTOMATICALLY ADJUST THE OUTLET IN DEPENDENCE ON A THROUGHPUT OF THE MATERIAL

BACKGROUND

1. Field of the Invention

The invention relates to an outlet device of a solid-bowl screw centrifuge for the separation of a multiphase material, with a centrifuge drum which is rotatable around a longitudinal axis and at least one outlet for discharging a phase of the material from centrifuge drum. The invention also relates to the use of such an outlet device on a solid-bowl screw centrifuge.

2. Description of the Related Art

Solid-bowl screw centrifuges are characterized by a rotatable centrifuge drum with a drum shell that is closed as far as possible, with a mostly horizontal rotational axis or longitudinal axis. The centrifuge drum is rotated at high rotational speed by means of a drive. Multiphase material that is to be centrifuged makes its way into the drum shell usually by means of a centrally disposed inlet pipe. The multiphase material then is subjected to a high centrifugal force as the centrifuge drum rotates, as a result of which it is deposited as a pool on the drum shell on the inside. A phase separation takes place in the material that has been centrifuged in such a way so that comparatively light material in the pool as a light phase migrates radially inwards and comparatively heavy material as a heavy phase migrates radially outwards. The light phase can be discharged radially inwards by means of an outlet device, whereas the heavy phase is conveyed out of the centrifuge drum by means of a screw.

The invention is based on the object of creating a solid-bowl screw centrifuge, at the outlet device of which an efficient recovery of drive energy is possible.

The invention relates to an outlet device of a solid-bowl screw centrifuge for the separation of multiphase material with a centrifuge drum that is rotatable around a longitudinal axis and at least one outlet for discharging a phase of the material from the centrifuge drum. The outlet is designed with a restrictor that is of an automatically adjusting design or that automatically adjusts itself in dependence upon a liquid level of the material in the centrifuge drum.

SUMMARY OF THE INVENTION

The material discharging from the outlet is held back in an automatically controlled manner by means of the restrictor and in this way ensures a uniformly high and at the same time closed liquid column at the outlet. Therefore, according to the invention an operation with varying flow volumes for the solid-bowl screw centrifuge can be carried out and a uniform pool depth or a uniform liquid level can be ensured. At the same time, it is not necessary, for example in the event of particularly high throughputs or flow volumes per time unit, to allow a surplus quantity of clarified material to flow out without being restricted.

By means of the restrictor according to the invention, on account of the restricting effect achieved therewith on the flow of discharging material the discharge speed of the flow at the outlet is furthermore increased at the same time and especially an optimum energy recovery is also achieved therewith.

The adjustment according to the invention of the restrictor is carried out especially advantageously by a floating body or float that is designed to float on the material. The floating body therefore acts as a control element for the throughput or the flow volume per time unit at the outlet. The floating body, on account of the centrifugal force acting upon it, is displaced radially outwards and at the same time floats on the pool. With a low pool depth, the float then opens the outlet a little less than when it floats further radially inwards on the material which is to be centrifuged.

The floating body in this case is mounted, preferably in a pivotable manner, on the centrifuge drum and by means of its pivoting movement moves especially a restricting body or a restrictor device at the outlet. The restricting body and the floating body in this case effect a force pair with a restricting force or stagnation force of the restricting body on the one hand and a buoyancy force of the floating body on the other hand. Restricting force and buoyancy force are matched to each so that these two forces are in equilibrium at a predetermined pool depth. In the case of a low pool depth, the restricting force predominates so that the restrictor is closed further. In the case of a greater pool depth, the buoyancy force predominates so that the restrictor is opened further until an equilibrium is established. The floating body is especially preferably designed with a cavity that is open towards one side, wherein this open side of the cavity advantageously faces the pool of the multiphase material. Any material, on account of the centrifugal force acting upon it, can then freely discharge radially outwards from the cavity.

Alternatively or additionally, the adjustment of the restrictor according to the invention advantageously is carried out by a weighted body that is subjected to the centrifugal force generated by the centrifuge drum. This centrifugal force, like the buoyancy force of the floating body and the restricting force as a result of the stagnation pressure, is proportional to the square of the rotational speed, as a result of which the ratio of the forces to each other is independent of the rotational speed. The dimensioning of the weighted body is correspondingly advantageously matched with the dimensioning of a floating body. The weighted body also preferably is mounted pivotably on the centrifuge drum. By means of this pivotable arrangement, a particularly simple and at the same time operationally reliable adjustment of the weighted body and of the components controlled by it is ensured.

The adjustment of the restrictor preferably is realized by means of a restricting body which is arranged in a discharge port of the outlet in the outflowing material there. The restricting body therefore covers a part of the cross-sectional area of the discharge port and therefore creates a cross sectional constriction at this port. In the region of the reduced cross-sectional area, the discharging or outflowing material is accumulated and consequently held back. At the same time, the velocity of the material flowing out through the discharge port is increased in comparison to the material backed up in front of it. The discharge port in this case is preferably arranged on a radius which is 1 to 2 times, preferably 1.05 to 1.6 times, especially preferably 1.1 to 1.4 times the radius of the intended liquid level of the material in the centrifuge drum. With this arrangement of the discharge port, the outflowing material is guided radially outwards on the centrifuge drum inside a closed liquid column in front of the restrictor of the invention and in this way the kinetic energy previously supplied to the material is at least partially recovered. The restricting body according to the invention is especially preferably also pivotably mounted, as a result of which the advantages already referred to above of a simple, operationally reliable adjustment are again ensured.

In this case, the restricting body of the invention is especially preferably of spherical design in the region of the discharge port. The at least partially spherical shape of the restricting body according to the invention creates a low-resistance circumflow around the restricting body by the flow of discharging material. Furthermore, with the spherical shape an advantageous sealing of the restricting body on an associated sealing seat is possible, as a result of which the associated discharge port can also be closed off altogether with sealing effect. Alternatively, the restricting body according to the invention is advantageously of conical or cylindrical design, at least in certain sections. With this shaping, a seal is created on an associated sealing seat on a then annular sealing edge of the restricting body.

For the adjustment of the restricting body according to the invention, this is advantageously displaceably mounted. The displacement is carried out especially preferably in the tangential direction to the rotational axis or longitudinal axis of the centrifuge drum. In this type of support, the restricting body is supported in the radial direction, that is to say in the direction of its centrifugal forces, and at the same is displaceable in the tangential direction. The displacement is therefore possible with especially little and largely constantly equal force expenditure. In the case of such an adjustment, the restricting body, as already explained above, is moved especially advantageously by the floating body and/or weighted body.

Alternatively to a restricting body, in or in front of a discharge port, it is provided in an advantageous development according to the invention to realize the adjustment of the restrictor by means of a diaphragm arrangement that is arranged around a discharge port of the outlet. Such a diaphragm arrangement enables a particularly accurate and at the same time uniform adjustment of the port cross-sectional area over the entire extent of the discharge port.

For the effective recovery of energy at the discharge port according to the invention it is also advantageous to design the outlet with a deflection device for deflecting the outflowing material there from the direction of the longitudinal axis of the centrifuge drum into a direction which is transverse to the longitudinal axis. The discharging flow then is deflected transversely to the longitudinal direction and essentially tangentially to this longitudinal axis in such a way that when leaving the centrifuge drum it releases its kinetic energy as an impulse to the centrifuge drum in opposition to its rotational direction.

To further improve this directed conducting of the material of the light phase, the outlet is preferably designed with a nozzle device for bundling the outflowing material there to form a jet. The discharged material is then discharged as a bundled jet and consequently generates a particularly high repelling impulse for the centrifuge drum.

In accordance with the aforesaid advantages, the invention is especially also focused in a directed manner on a use of an outlet device according to the invention on a solid-bowl screw centrifuge.

Exemplary embodiments of the solution according to the invention are explained in more detail below with reference to the attached schematic drawings.

DETAILED DESCRIPTION

Figure 1:
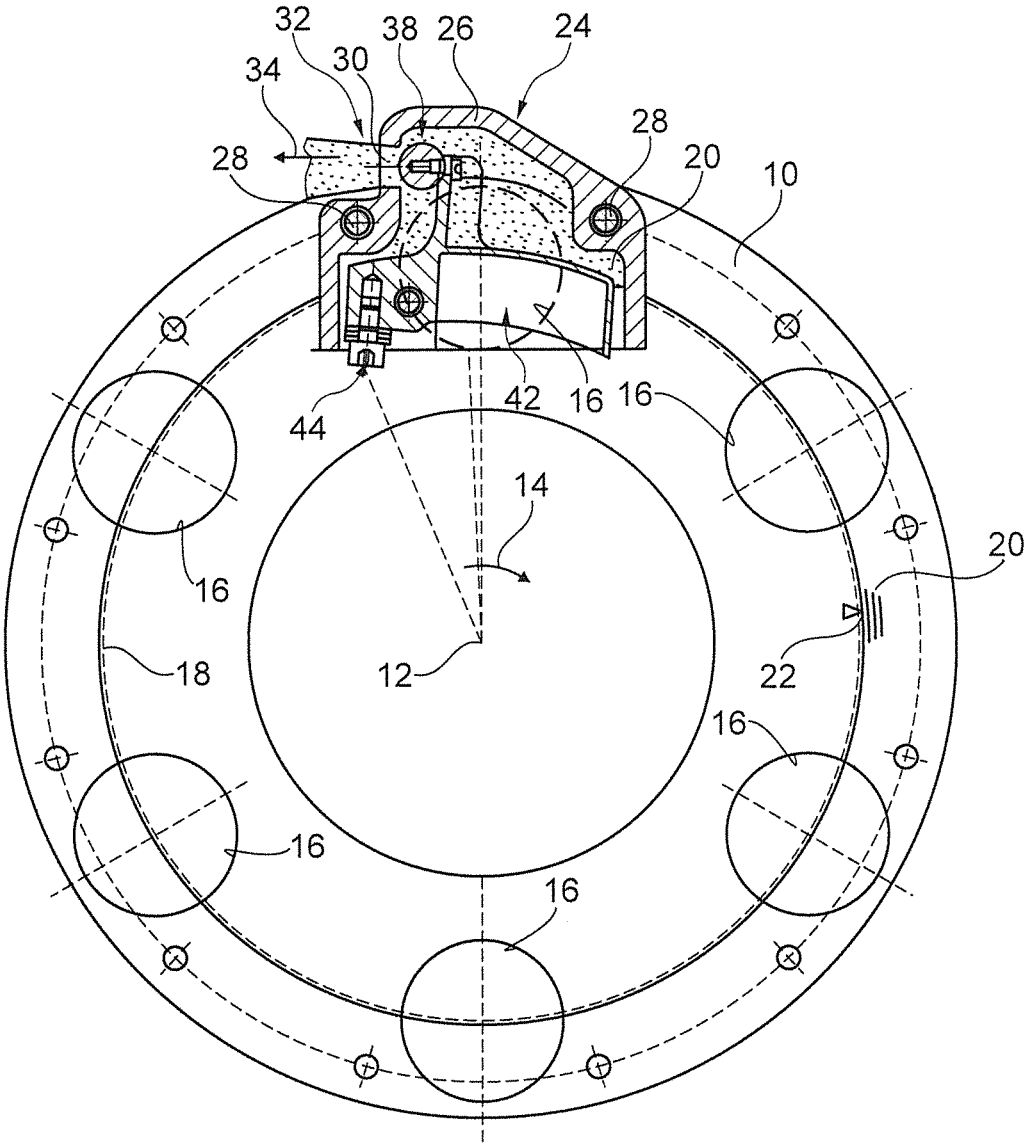
FIG. 1 shows a view of the end face of a centrifuge drum of a solid-bowl screw centrifuge with an outlet device according to the invention arranged thereupon for discharging material from the centrifuge drum.

Shown in FIG. 1 is an end wall or end face 10 of a centrifuge drum which according to the conventional type of construction of a solid-bowl screw centrifuge accommodates a centrifuge screw (not shown) in its interior. The centrifuge drum is rotatable at high speed around a longitudinal axis 12 in one rotational direction 14.

Arranged on the end face 10 of the centrifuge drum, and uniformly spaced apart around the longitudinal axis 12 over a circle with a radius 18, are six circular end-wall openings 16 in each case. The end-wall openings 16 serve for conducting away or discharging clarified material 20 of a light phase from the centrifuge drum. The material 20 forms a pool or a liquid ring in the centrifuge drum on the inside of its shell. In this case, the pool has a radius or liquid level 22 which in the main is dependent on the throughput of material 20 to be clarified in the centrifuge drum. If an excessive amount of material 20 to be clarified is fed into the centrifuge drum per time unit, but only a little clarified material 20 of the light phase is discharged per time unit, then the liquid level 22 rises or the associated radius becomes smaller. If relatively more material 20 is discharged, then the liquid level 22 falls. The liquid level 22 naturally also depends in this case on the quantity of material 20 of the heavy phase which is discharged per time unit from the centrifuge drum, which, however, shall not be discussed further here. The liquid level 22 corresponds as a rule approximately to the radius 18 so that the outflowing material 20 flows through the end-wall openings 16, as seen in the radial direction, approximately in the region of its broadest extent.

Attached in front of each of the end-wall openings 16, on the outer side on the end face 10 of the centrifuge drum, is an outlet device 24. Each outlet device 24 is designed with a shell-like housing 26 which is open towards the associated end-wall opening 16, but outwardly (axially and radially) is otherwise essentially closed. The shell form of the housing 26 is designed in this case so that the material 20 can flow axially outwardly from the interior of the centrifuge drum through the end-wall opening 16 but is then initially held back there by the housing 26. For this, the housing 26 is fastened in a fixed and fluidtight manner on the end face 10 by means of two screws 28. Two holes are formed in the housing 26 for the screws 28 in this case. Alternatively to these holes, provision can also be made in the housing 26 (essentially radially oriented) for elongated holes by means of which the housing 26 can be attached in a radially adjustable manner on the end face 10 of the centrifuge drum.

Located in the housing 26, radially on the outside from the liquid level 22, is an outlet 32 formed by a discharge port 30 by means of which the clarified material 20 can be discharged in a directed manner from the housing 26 towards the outside into the environment of the centrifuge drum. The discharge port 30 is a circular through-opening or hole in the housing 26, and the outlet direction or passage direction 34 of the discharge port 30 is oriented in the tangential direction and transversely to the longitudinal axis 12. The discharge port 30 is arranged on a radius which is 1.1 times to 1.4 times, especially 1.2 times to 1.3 times the radius of the intended liquid level 22 of the material 20 in the centrifuge drum. The housing 26 together with the discharge port 30 consequently form a deflection device for deflecting the flowing material 20 out there from the direction of the longitudinal axis 12 of the centrifuge drum into a direction which is transverse to the longitudinal axis 12.

In front of the discharge port 30, in the flow direction, a restricting body 36, which is spherical according to FIGS. 1 to 5, is located inside the housing 26. The restricting body 36 forms a variable restrictor 38 at the discharge port 30, by means of which the passage of outflowing, clarified material 20 through the discharge port 30 can be restricted. To this end, the restricting body 36 can be located close, or closer, to the discharge port 30 or can be at a distance, or further away, from this so that an annular restricting gap 40 is formed at the discharge port 30 which the outflowing material 20 has to move through. Depending on the width of the restricting gap 40, its cross-sectional area is correspondingly larger or smaller and therefore the flow resistance for the outflowing material 20 is also smaller or larger.

Figure 2:
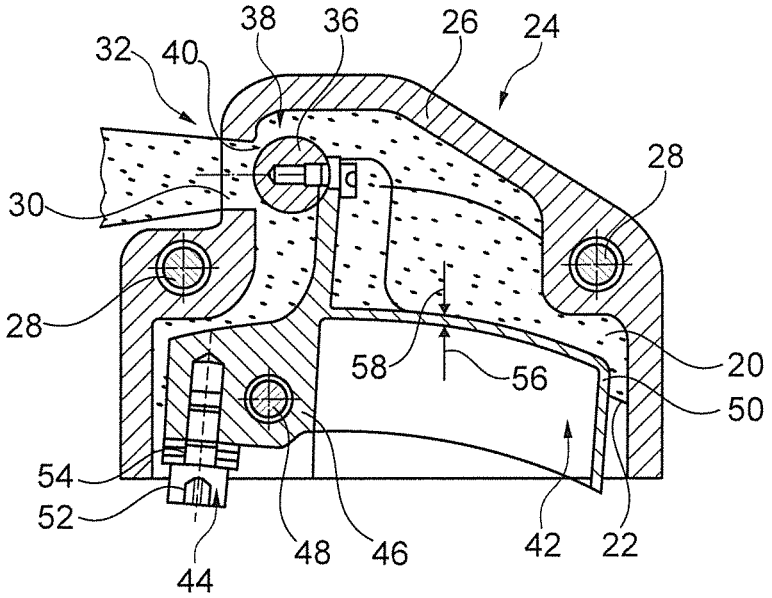
FIG. 2 shows an enlarged view of the outlet device according to FIG. 1.
Figure 3:
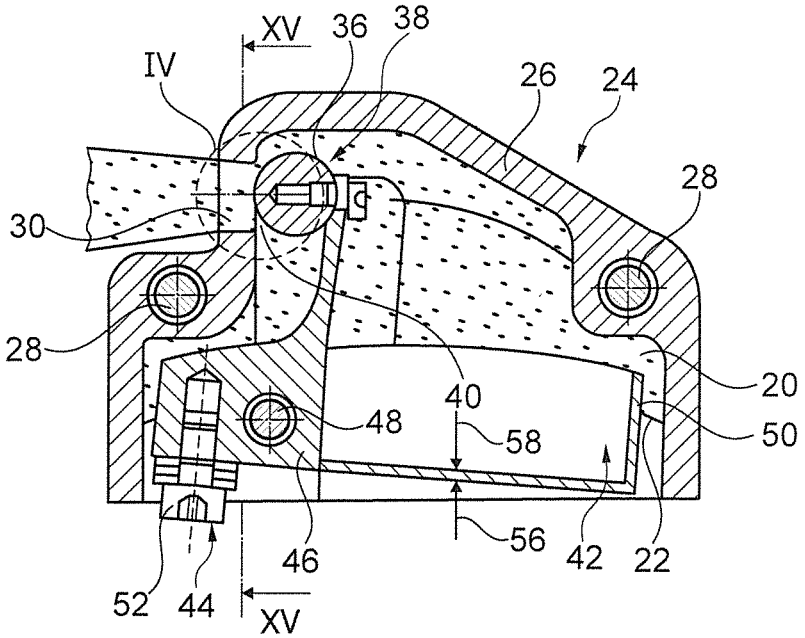
FIG. 3 shows the view according to FIG. 1 of an alternative outlet device according to the invention.
Figure 4:
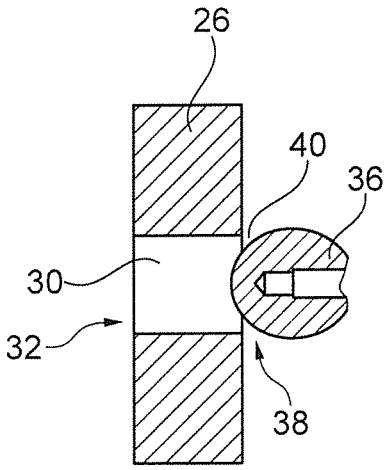
FIG. 4 shows an enlarged view of the detail IV in FIG. 3 of an outlet.
Figure 5:
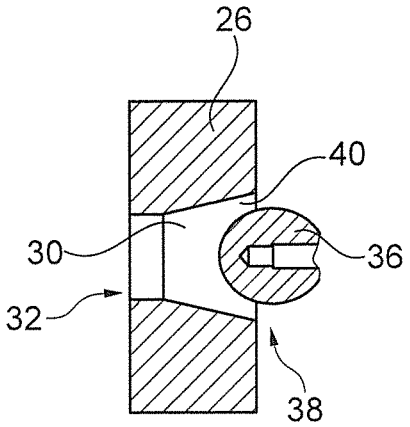
FIG. 5 shows the view according to FIG. 4 of a first, alternative outlet according to the invention.
Figure 6:
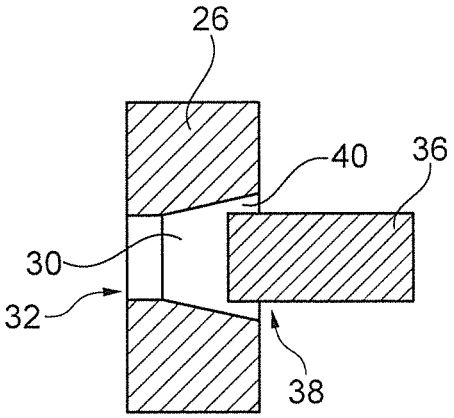
FIG. 6 shows the view according to FIG. 4 of a second, alternative outlet according to the invention.
Figure 7:
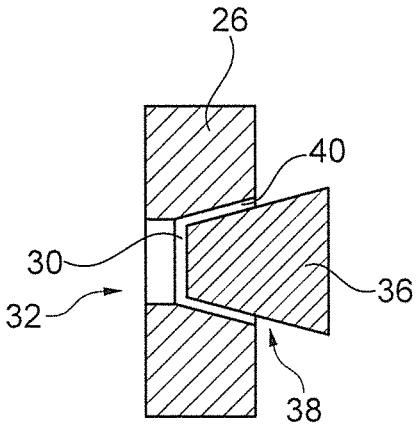
FIG. 7 shows the view according to FIG. 4 of a third, alternative outlet according to the invention.

The controlling of the size of the restriction orifice of the restrictor 38 and especially of the width of the restricting gap 40 is carried out in the exemplary embodiments according to FIGS. 1 to 3 by means of a floating body 42 or a weighted body 44 which together with the restricting body 36 is mounted on a lever 46 inside the body 26 in a rotatable or pivotable manner around a rotational axis 48.

The rotational axis 48 is designed as a pin which is fixedly attached on the housing 26 on the inner side, extending in the direction of the longitudinal axis 12.

The floating body 42 is formed by means of an internally hollow shell 50 which floats on the material 20 at the liquid level 22. The shell form is open in the direction towards the middle point of the centrifuge drum in the case of the exemplary embodiment according to FIGS. 1 and 2, whereas in the case of the exemplary embodiment according to FIG. 3 it is open in the direction towards the drum wall or towards the pool. With this embodiment, any material 20 transfers radially outwards from the interior of the shell 50 into the pool on account of the centrifugal force and no material 20 can accumulate in the shell 50. As the liquid level 22 rises, the floating body 42 moves radially inwards, as a result of which it moves the restricting body 36 away from the discharge port 30 on account of the lever connection acting around the rotational axis 48 and opens an enlarged restricting gap 40.

The weighted body 44 is formed by means of a screw 52 and a plurality of disks 54 which by means of the screw 52 are fixedly attached on the lever 46. The screw 52 together with the disks 54 are subjected to the centrifugal force during operation of the associated solid-bowl screw centrifuge in such a way that they are displaced radially outward and therefore support the floating body 42 during the opening of the restrictor 38. By varying the number of disks 54, the weight of the weighted body 44, and consequently the liquid level 22, can be altered, wherein an equilibrium is established at the restrictor 38. Therefore, a balance of forces is created on the rotational axis 48 between a flywheel effect or centrifugal force 56 created by the weighted body 44 and also by the shell 50 and a buoyancy force 58 of the floating body 42. These two forces 56 and 58 determine how far the restrictor 38 is opened or closed. In this way, according to the invention the respectively optimum passage cross section at the restricting gap 40 is set and an effective atomization of the outflowing material 20 is also achieved in the case of different throughputs. At the outlet device 24, the discharge port 30 there is therefore restricted automatically, variably and in a manner independent of rotational speed. In this case, a closed liquid column of material 20 is present in front of the discharge port 30 in the flow direction of the material 20, creating a corresponding hydraulic pressure for ejecting the material 20 through the discharge port 30. This ejection is carried out essentially tangentially opposite to the rotational direction 14 of the associated centrifuge drum and therefore generates a recoil for this, on account of which a saving is made in drive energy for rotating the centrifuge drum.

Figure 8:
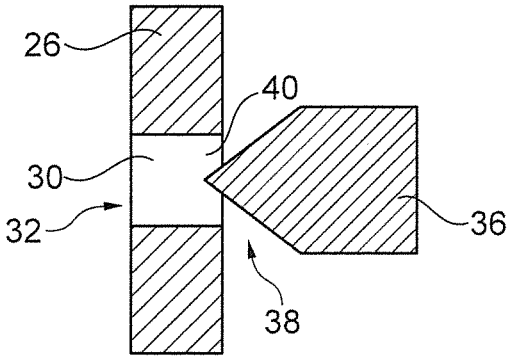
FIG. 8 shows the view according to FIG. 4 of a fourth, alternative outlet according to the invention.

FIGS. 4 to 8 show different embodiments of discharge ports and associated restricting bodies 36. In the case of the embodiment according to FIG. 4, the discharge port 30 through the associated wall of the housing 26 is of cylindrical, especially circular cylindrical, design. According to FIG. 5, the discharge port 30 is of conical design on a section facing the restricting body 36, wherein, as already mentioned above, the restricting body 36 is of spherical design in each case. According to FIG. 6, a cylindrical restricting body 36 is arranged at a sectionally conical discharge port 30 and according to FIG. 7 both the discharge port 30 and the restricting body 36 are of conical design. With the conical shape of the discharge port 30 this especially forms a nozzle device at the outlet 32 for bundling the material 20 flowing out there to form a jet. The embodiment according to FIG. 8 is finally designed with a cylindrical discharge port 30 and a conical, pointed restricting body 36.

Figure 9:
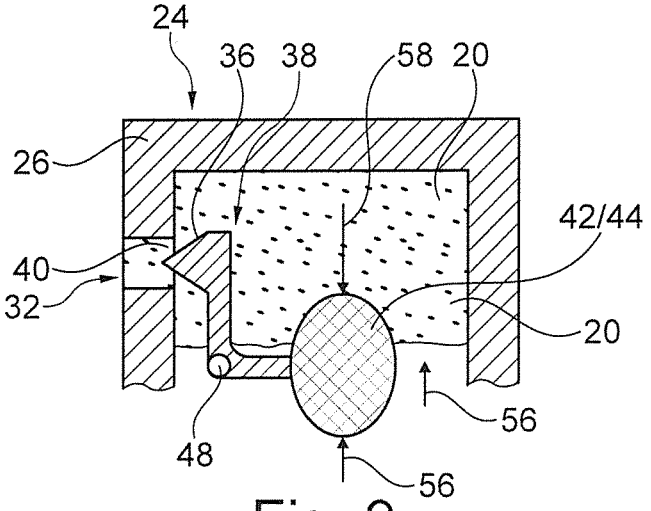
FIG. 9 shows a greatly simplified view according to FIG. 1 of the functioning principle of the outlet device there.
Figure 10:
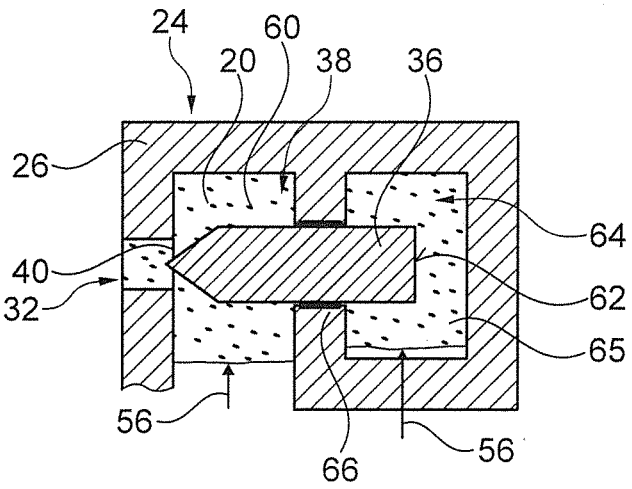
FIG. 10 shows the view according to FIG. 9 of a first, alternative functioning principle according to the invention.

In FIG. 9, the functional operating principle of the centrifugal force 56 and buoyancy force 58 acting on the lever 46 is once more illustrated in a simplified manner. FIG. 10 shows an alternative functioning principle in which a restricting body 36 is moved or adjusted hydraulically. To this end, the restricting body 36, in a first chamber 60 in front of the discharge port 30, is displaceably mounted as a cylinder essentially tangentially to the longitudinal axis 12. The face end or the end face 62 of the cylindrical restricting body 36 of such a type which points away from the discharge port 30 is enclosed by a second, self-contained chamber 64 in which is contained a liquid 65 which is also subjected to the centrifugal force 56. The second chamber 64 is sealed off from the first chamber 60 by means of a partition 66 which the cylindrical restricting body 36 penetrates in a fluidtight and sealed manner. The centrifugal force 56 correspondingly acts upon the liquid 65 which is in the second chamber 64 in such a way that the liquid 65 is pressed against the end face 62 of the restricting body 36 in order to displace this in the direction towards the discharge port 30. At the same time, the hydraulic force of the material 20 flowing out there, which is also subjected to the centrifugal force 56, acts at the discharge port 30, as a result of which the restricting body 36 is pushed away from the discharge port 30 and with a corresponding force ratio a restricting gap 40 is opened.

Figure 11:
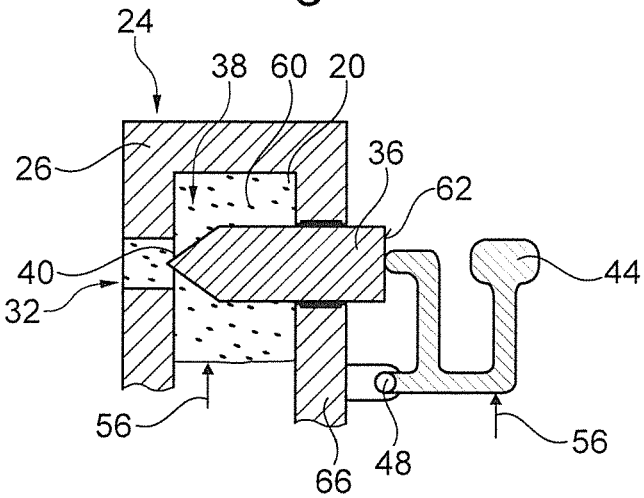
FIG. 11 shows the view according to FIG. 9 of a second, alternative functioning principle according to the invention.

Illustrated in FIG. 11 is an embodiment in which the associated, also cylindrical restricting body 36 is also guided in a tangentially movable manner in a chamber 60 in front of the discharge port 30 in a fluidtight manner by means of a partition 66. In this case, a hydraulic pressure does not act upon the end face 62 of the restricting body 36 but the force of a weighted body 44 acts thereupon. For this, the weighted body 44, on the side of the partition 66 facing away from the discharge port 30, is mounted on this by means of a pivot axis or rotational axis 48 in such a way that the centrifugal force 56 acting upon it is deflected into the tangential direction.

Figure 12:
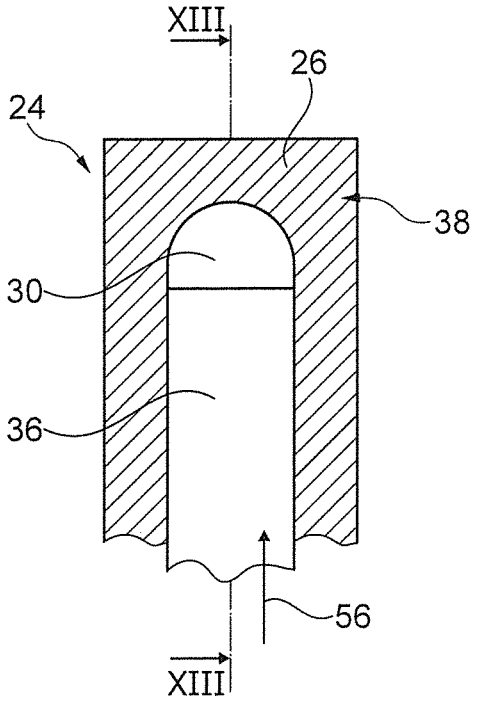
FIG. 12 shows a section of a fifth, alternative outlet according to the invention.
Figure 13:
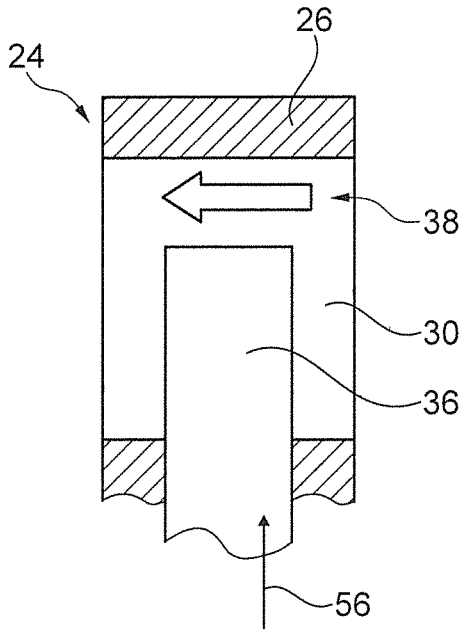
FIG. 13 shows the section XIII-XIII according to FIG. 12.

Illustrated by FIGS. 12 and 13 is an embodiment in which the restricting body 36 is guided not in the tangential direction but in the radial direction. The restricting body 36 in this case projects into the discharge port 30 and partially closes this off. The adjustment of the restricting body 36 is also carried out in this case by means of a floating body 42 (not shown here) and, if necessary, a weighted body 44 (not shown here).

Figure 14:
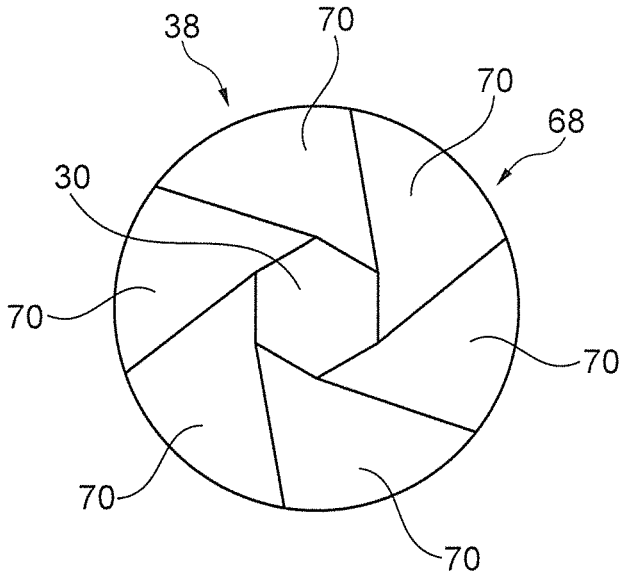
FIG. 14 shows a simplified view of a sixth, alternative outlet according to the invention.

According to FIG. 14, the restrictor 38 is finally formed with the aid of a diaphragm arrangement 68 which is arranged radially on the outside around the discharge port 30. The diaphragm arrangement 68 is formed with altogether six diaphragm blades 70 which are arranged at regular distances around the discharge port 30 and are radially inwardly or radially outwardly adjustable in order to decrease or to increase the area of the discharge port 30 through which flow can pass. The adjustment of the diaphragm blades 70 is also carried out in this case by means of a floating body 42 and/or weighted body 44 (not shown here).

Figure 15:
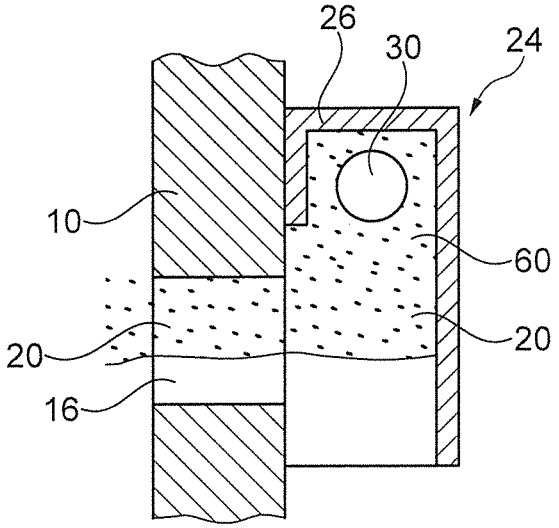
FIG. 15 shows the section XV-XV in FIG. 3.
Figure 16:
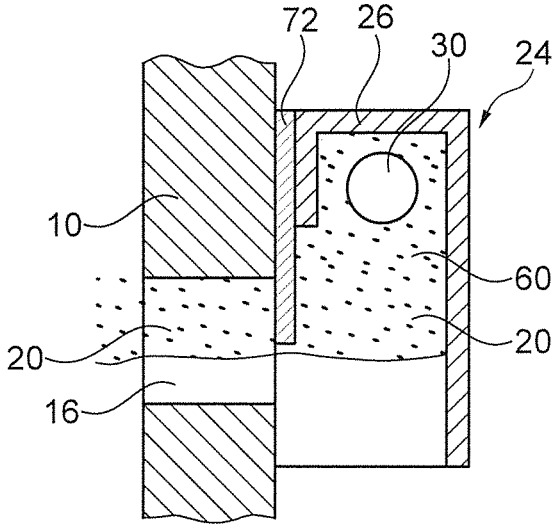
FIG. 16 shows the section according to FIG. 15 of an alternative outlet device according to the invention.

Shown in FIG. 16 is an embodiment in which in contrast to the embodiment according to FIG. 15 a weir plate 72 is arranged between the interior of the centrifuge drum and the chamber 60. The weir plate 72 is located on the outer side of the end wall 10 and holds back the material 20 there in such a way that only a phase which has been clarified as far as possible or a pure liquid phase can flow over the weir plate 72 into the chamber 60 and then flow through the discharge port 30.

In conclusion, it may be noted that independent protection is also to be granted individually or in any combination to all the features which are referred to in the application documents and especially in the dependent claims, despite the formal reference made to one or more specific claim(s).

LIST OF DESIGNATIONS

10 End face of a centrifuge drum
12 Longitudinal axis
14 Rotational direction
16 End-wall opening
18 Radius
20 Material
22 Liquid level
24 Outlet device
26 Housing
28 Screw
30 Discharge port
32 Outlet
34 Passage or outlet direction of the discharge port
36 Restricting body
38 Restrictor
40 Restricting gap
42 Floating body
44 Weighted body
46 Lever
48 Rotational axis
50 Shell
52 Screw
54 Disk
56 Centrifugal force
58 Buoyancy force
60 First chamber
62 End face
64 Second chamber
65 Liquid
66 Partition
68 Diaphragm arrangement
70 Diaphragm blade
72 Weir plate

What is claimed is:

1. An outlet device (24) of a solid-bowl screw centrifuge for separation of multiphase material (20), the solid-bowl screw centrifuge having a centrifuge drum that is rotatable around a longitudinal axis (12), the centrifuge drum having an end face (10) with at least one end-wall opening (16), the outlet device (24) being attached in front of the end-wall opening (16) on an outer side on the end face (10) of the centrifuge drum, the outlet device having a shell-shaped housing (26) that is open toward the associated end-wall opening (16), an outlet (32) for discharging a phase of the material (20) from the centrifuge drum being located in the housing (26) radially outside from a liquid level (22) of the material (20) in the centrifuge drum and having a restrictor (38) that automatically adjusts in dependence on the liquid level (22) of the material (20) in the centrifuge drum, whereby the liquid level (22) is dependent on a throughput of the material (20), and the adjustment of the restrictor (38) is controlled by a floating body (42) that is designed to float on the material (20).

2. The outlet device of claim 1, wherein the adjustment of the restrictor (38) is controlled by a weighted body (44) that is subjected to a centrifugal force (56) generated by the centrifuge drum.

3. The outlet device of claim 1, wherein the adjustment of the restrictor (38) is realized by a restricting body (36) that is arranged in a discharge port (30) of the outlet (32) in the material (20) flowing out there.

4. The outlet device of claim 3, wherein the restricting body (36) in the region of the discharge port (30) is of spherical design.

5. The outlet device of claim 4, wherein the restricting body (36) is mounted displaceably.

6. The outlet device of claim 1, wherein the outlet (32) has a nozzle device for bundling the material (20) flowing out there to form a jet.

7. An outlet device of a solid-bowl screw centrifuge for separation of multiphase material (20), the solid-bowl screw centrifuge having a centrifuge drum that is rotatable around a longitudinal axis (12) and at least one outlet (32) for discharging a phase of the material (20) from the centrifuge drum, the outlet (32) being designed with a restrictor (38)

that automatically adjusts in dependence on a liquid level (22) of the material (20) in the centrifuge drum, whereby the liquid level (22) is dependent on a throughput of the material (20), and the adjustment of the restrictor (38) is controlled by a floating body (42) that is designed to float on the material (20), wherein the adjustment of the restrictor (38) is carried out by a diaphragm arrangement (68) that is arranged around a discharge port (30) of the outlet (32).

8. An outlet device of a solid-bowl screw centrifuge for separation of multiphase material (20), the solid-bowl screw centrifuge having a centrifuge drum that is rotatable around a longitudinal axis (12) and at least one outlet (32) for discharging a phase of the material (20) from the centrifuge drum, the outlet (32) being designed with a restrictor (38) that automatically adjusts in dependence on a liquid level (22) of the material (20) in the centrifuge drum, whereby the liquid level (22) is dependent on a throughput of the material (20), and the adjustment of the restrictor (38) is controlled by a floating body (42) that is designed to float on the material (20), wherein the outlet (32) is designed with a deflection device for deflecting the material (20) flowing out there from a direction of the longitudinal axis (12) of the centrifuge drum into a direction that is transverse to the longitudinal axis (12).

* * * * *